US009442433B2

(12) United States Patent
Okura

(10) Patent No.: US 9,442,433 B2
(45) Date of Patent: Sep. 13, 2016

(54) IMAGE FORMING APPARATUS

(71) Applicant: KYOCERA Document Solutions Inc., Osaka (JP)

(72) Inventor: Tomohisa Okura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/848,071

(22) Filed: Sep. 8, 2015

(65) Prior Publication Data

US 2016/0077469 A1 Mar. 17, 2016

(30) Foreign Application Priority Data

Sep. 16, 2014 (JP) ..... 2014-187668

(51) Int. Cl.
*G03G 15/16* (2006.01)

(52) U.S. Cl.
CPC *G03G 15/1675* (2013.01); *G03G 2215/00776* (2013.01)

(58) Field of Classification Search
CPC ..... G03G 15/1665; G03G 15/167; G03G 15/1675
See application file for complete search history.

(56) References Cited

U.S. PATENT DOCUMENTS 5,717,980 A * 2/1998 Oka ..... G03G 15/1645 399/316
6,148,159 A * 11/2000 Shiraishi ..... G03G 15/0131 399/299
6,253,037 B1 * 6/2001 Park ..... G03G 15/1695 399/44
8,229,311 B2 * 7/2012 Yanagihara ..... G03G 15/1675 399/44
2012/0177391 A1 * 7/2012 Lee ..... G03G 15/161 399/66
2015/0346683 A1 * 12/2015 Kobayashi ..... G03G 15/1675 399/31

FOREIGN PATENT DOCUMENTS

JP 11-219042 * 8/1999 ..... G03G 15/00
JP 2000-194206 A 7/2000

* cited by examiner

*Primary Examiner* — David Gray
*Assistant Examiner* — Carla Therrien
(74) *Attorney, Agent, or Firm* — Studebaker & Brackett PC

(57) ABSTRACT

An image forming apparatus includes an image bearing member, a transfer section, a transfer bias applying section, a conveyance section, an element, a current measurement section, and a control section. The transfer section forms, in conjunction with the image bearing member, a pressing part where a recording medium is pressed. The transfer bias applying section supplies transfer current to the transfer section to apply a transfer bias to the transfer section. The element conducts when a voltage equal to or greater than a prescribed value is applied thereto. The current measurement section measures a value of leak current. The leak current is a current flowing through the element. The control section controls a value of the transfer current. The control section changes the absolute value of the transfer current based on the absolute value of the leak current.

14 Claims, 5 Drawing Sheets

IMAGE FORMING APPARATUS

INCORPORATION BY REFERENCE

The present application claims priority under 35 U.S.C. §119 to Japanese Patent Application No. 2014-187668, filed on Sep. 16, 2014. The contents of this application are incorporated herein by reference in their entirety.

BACKGROUND

The present disclosure relates to an image forming apparatus.

An electrophotographic image forming apparatus is known. An electrophotographic image forming apparatus typically forms an image on paper by performing processes such as charging, light exposure, development, and transfer.

More specifically, an outer circumferential surface (hereinafter, referred to as an "image bearing surface") of a photosensitive drum, which is an image bearing member, is uniformly charged to a specific electrical potential of a first polarity (for example, positive polarity) in a charging process. Next, the image bearing surface is exposed to light in a light exposure process so as to form an electrostatic latent image on the image bearing surface. Thereafter, the electrostatic latent image on the image bearing surface is developed in a development process using charged toner. A toner image is formed on the image bearing surface through the development process. In a situation in which development is performed by reversal development, toner charged to the same polarity (first polarity) as the image bearing surface is used.

After the development process, a transfer bias of a second polarity that is opposite to the first polarity is supplied to a transfer roller pressed against the photosensitive drum in a transfer process. The toner image formed on the image bearing surface is transferred onto paper as the paper passes through a pressing part (a nip) between the photosensitive drum and the transfer roller. An image is formed on the paper through the transfer process. After the transfer process, cleaning and static elimination are performed on the image bearing surface before starting a next charging process.

In a situation in which paper is moist in a high-humidity environment, transfer current may leak through the paper to a paper conveyance section disposed around the photosensitive drum. It is known to connect a resistance with the sheet conveyance section in order to restrict leak current from the transfer current.

SUMMARY

An image forming apparatus according to the present disclosure includes an image bearing member, a transfer section, a transfer bias applying section, a conveyance section, an element, a current measurement section, and a control section. The image bearing member bears a toner image thereon. The transfer section forms, in conjunction with the image bearing member, a pressing part where a recording medium is pressed. The transfer section transfers the toner image from the image bearing member to the recording medium as the recording medium passes through the pressing part. The transfer bias applying section supplies transfer current to the transfer section to apply a transfer bias to the transfer section. The conveyance section conveys the recording medium in a conveyance direction toward the pressing part. The element is connected with the conveyance section. The element conducts when a voltage equal to or greater than a prescribed value is applied thereto. The current measurement section measures a value of leak current. The leak current is a current flowing through the element. The control section controls a value of the transfer current. The control section changes an absolute value of the transfer current based on an absolute value of the leak current.

DETAILED DESCRIPTION

Figure 1:
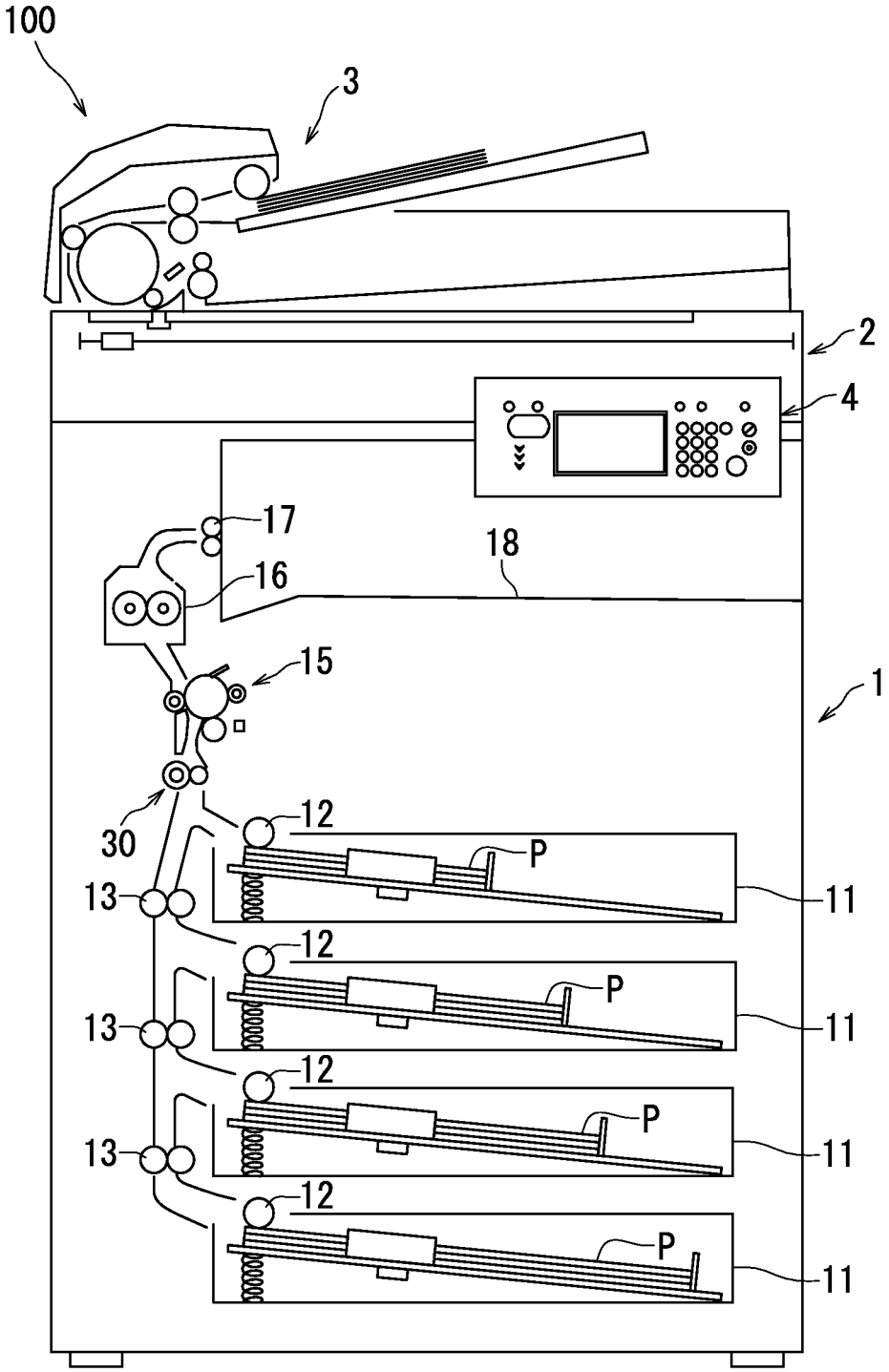
FIG. 1 is a diagram illustrating configuration of an example of an image forming apparatus according to an embodiment.

Hereinafter, an embodiment of the present disclosure will be described with reference to the accompanying drawings. It should be noted that elements in the drawings that are the same or equivalent are labelled using the same reference signs and description thereof is not repeated.

FIG. 1 is a diagram illustrating configuration of an example of an image forming apparatus according to the embodiment.

An image forming apparatus 100 is for example a multifunction peripheral (MFP). The image forming apparatus 100 has the functions of a scanner, a copier, a printer, and a facsimile (fax) machine. The image forming apparatus 100 includes an image forming unit 1, an image scanning unit 2, a document conveyance device 3, and an operation panel 4. The image forming unit 1 forms an image on paper P, which is an example of the recording medium. The image scanning unit 2 scans an image of a document. The document conveyance device 3 conveys a document that is a scanning target. The operation panel 4 is a device through which the image forming apparatus 100 is operated by a user.

The image forming unit 1 includes paper feed cassettes 11, paper feed rollers 12, conveyance roller pairs 13, a registration roller pair 30, which is an example of the conveyance section, an image forming section 15, a fixing device 16, an ejection roller pair 17, and an exit tray 18. The paper feed rollers 12 pick up paper P from the paper feed cassettes 11 one sheet at a time. The paper P picked up by the paper feed rollers 12 is conveyed to the image forming section 15 by the conveyance roller pairs 13 and the registration roller pair 30.

The image forming section 15 performs an image formation process to form an image on the paper P conveyed from the paper feed cassettes 11 based on image data. Once an image has been formed on the paper P by the image forming section 15, the paper P is conveyed to the fixing device 16. Detailed description of the image forming section 15 is provided further below with reference to FIG. 2.

The fixing device 16 thermally fixes, onto the paper P, the image that has been formed on the paper P. The fixing device 16 includes a heating roller and a pressure roller. The heating roller has an internal heating member. The heating roller and the pressure roller are pressed against one another to form a fixing nip therebetween. Toner on the surface of the paper P is heated and melted as the paper P passes through the fixing nip. As a result, a toner image is fixed onto the paper P. The paper P having the toner image fixed thereto is ejected onto the exit tray 18 by the ejection roller pair 17.

Figure 2:
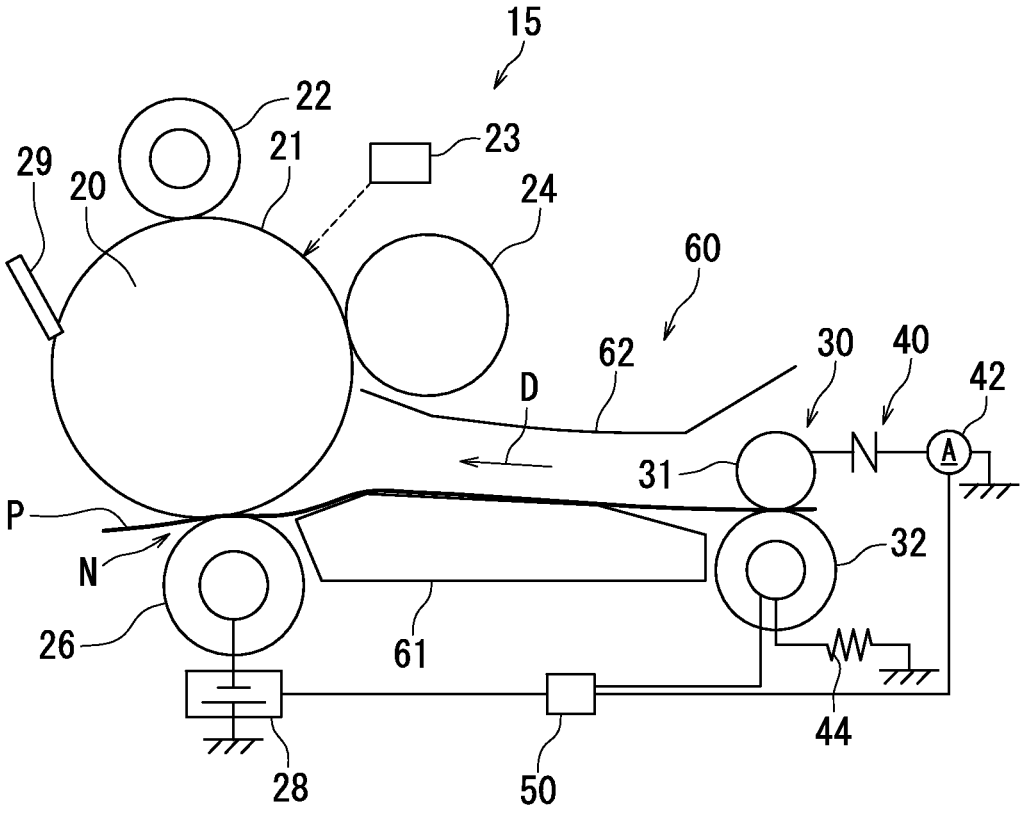
FIG. 2 is a diagram illustrating configuration of an example of an image forming section and elements therearound according to the embodiment.

FIG. 2 is a diagram illustrating configuration of an example of the image forming section 15 and elements therearound according to the embodiment.

The image forming section 15 includes a photosensitive drum 20, a charging roller 22, a development roller 24, a transfer roller 26 (transfer section), a transfer bias applying section 28, a cleaning blade 29, and a control section 50.

The photosensitive drum 20 is an image bearing member and bears thereon a toner image formed with positively charged toner. The photosensitive drum 20 is approximately cylindrical. An outer circumferential surface of the photosensitive drum 20 is an image bearing surface 21 on which an electrostatic latent image and a toner image are formed. The image bearing surface 21 is for example formed from an organic photosensitive member.

In the present embodiment, the photosensitive drum 20 rotates in a clockwise direction in FIG. 2. The charging roller 22, a light exposure device 23, the development roller 24, the transfer roller 26, and the cleaning blade 29 are arranged around the photosensitive drum 20 in the stated order in terms of the rotation direction of the photosensitive drum 20. The charging roller 22, the light exposure device 23, the development roller 24, the transfer roller 26, and the cleaning blade 29 each perform a specific process on a region of the image bearing surface 21 located opposite thereto (hereinafter, referred to as an "opposite region"). As a result of rotation of the photosensitive drum 20, a given region of the image bearing surface 21 becomes sequentially located opposite to the charging roller 22, the light exposure device 23, the development roller 24, the transfer roller 26, and the cleaning blade 29. Through the above, a charging process by the charging roller 22, a light exposure process by the light exposure device 23, a development process by the development roller 24, a transfer process by the transfer roller 26, and a cleaning process by the cleaning blade 29 are performed on the given region of the image bearing surface 21 in the stated order.

In the charging process, the charging roller 22 receives a charging bias of positive polarity and uniformly charges an opposite region to a specific electrical potential of positive polarity. In the present embodiment, the charging bias of positive polarity is a direct current bias. An outer circumferential surface of the charging roller 22 is for example formed from a rubber material. The charging roller 22 is in contact with the image bearing surface 21. As a result, the charging roller 22 is rotationally driven by the photosensitive drum 20.

In the light exposure process, the light exposure device 23 outputs laser light based on image data and exposes an opposite region to the laser light. The light exposure process is performed with respect to the entirety of a process target region of the image bearing surface 21. As a result, an electrostatic latent image corresponding to the image data is formed in the process target region. The term process target region refers to a region of the image bearing surface 21 that is used to form an image indicated by the image data on a sheet of paper P.

The development roller 24 develops the electrostatic latent image on an opposite region using positively charged toner in the development process. In the present embodiment, the image forming apparatus 100 performs development by reversal development. That is, the development roller 24 supplies toner charged to the same polarity (positive polarity in the present embodiment) as the image bearing surface 21 to a section of the image bearing surface 21 from which electrical charge has been eliminated through the light exposure process thereby to form a toner image on the image bearing surface 21.

The development roller 24 is rotatably supported by a housing of the development roller 24. A development bias is supplied to the development roller 24. As a result, charged toner detaches from the development roller 24 and is supplied to the image bearing surface 21 to develop the electrostatic latent image on the image bearing surface 21.

The transfer roller 26 forms, in conjunction with the photosensitive drum 20, a pressing part N where the paper P is pressed. The transfer roller 26 is a transfer device. The transfer roller 26 receives a transfer bias of negative polarity and transfers the toner image from the image bearing surface 21 onto the paper P as the paper P passes through the pressing part N. Since the transfer roller 26 is in pressed contact with the photosensitive drum 20, the pressing part N is formed between the transfer roller 26 and an opposite region for the transfer roller 26. In the present embodiment, the toner image is transferred by direct transfer in which the paper P comes in direct contact with the photosensitive drum 20.

In the transfer process, the transfer roller 26 transfers the toner image onto the paper P from the opposite region. The opposite region for the transfer roller 26 is a region on which the development process has been performed prior to the region becoming located opposite to the transfer roller 26. The transfer process is performed with respect to the entirety of the process target region. As a result, the toner image corresponding to the image data is transferred onto the paper P. The transfer bias of negative polarity is supplied to the transfer roller 26 while the paper P is passing through the pressing part N and for a specific period of time before and after the paper P passes through the pressing part N.

The transfer bias applying section 28 applies the transfer bias to the transfer roller 26 by supplying transfer current to the transfer roller 26.

In the cleaning process, the cleaning blade 29 removes residual toner remaining on an opposite region. The opposite region for the cleaning blade 29 is a region on which the transfer process has been performed prior to the region becoming located opposite to the cleaning blade 29.

The cleaning blade 29 is a plate shaped member that is for example formed from a rubber material. The cleaning blade 29 has an edge that is in contact with the image bearing surface 21 thereby to collect toner remaining on the image bearing surface 21.

The registration roller pair 30 has a first roller 31 and a second roller 32. The first roller 31 is made from metallic stainless steel (SUS). The second roller 32 includes a metallic shaft and an elastic layer of ethylene propylene diene monomer rubber (EPDM rubber) disposed around the shaft. The registration roller pair 30 conveys the paper P in a conveyance direction D toward the pressing part N. The second roller 32 is grounded through a resistance 44. The resistance 44 has a resistance value of 100 MΩ.

The image forming apparatus 100 includes a varistor 40 (element), a current measurement section 42, and a guide member 60.

The varistor 40 conducts when a voltage equal to or greater than a specified value (hereinafter, referred to as "varistor voltage") is applied thereto. The varistor 40 is connected with the first roller 31. The varistor voltage is −200 V.

The current measurement section 42 is connected with the varistor 40. The varistor 40 is grounded through the current measurement section 42. The current measurement section 42 measures the value of electric current (hereinafter, referred to as "leak current") flowing through the varistor 40.

The control section 50 controls the value of the transfer current. The control section 50 changes the absolute value of the transfer current based on the absolute value of the leak current. The control section 50 is connected with the second roller 32.

The guide member 60 has a first guide member 61 and a second guide member 62. The guide member 60 guides the paper P toward the pressing part N.

Typically, in a situation in which paper P is moist, current applied to the transfer roller 26 may flow through the paper P into a member in contact with the paper P. In such a situation, the transfer bias applied to the transfer roller 26 is transferred to the registration roller pair 30 through the paper P, and a high voltage equal to or greater than the varistor voltage is applied to the registration roller pair 30. As a result, the varistor 40 conducts, and leak current flows therethrough. The current measurement section 42 measures the value of the leak current, and the control section 50 changes the absolute value of the transfer current based on the absolute value of the leak current.

On the contrary, in a situation in which the paper P is not moist, the transfer bias applied to the transfer roller 26 is not transferred to the registration roller pair 30 through the paper P, and therefore a high voltage equal to or greater than the varistor voltage is not applied to the registration roller pair 30. As a result, the varistor 40 does not conduct, and leak current does not flow therethrough. Accordingly, the control section 50 does not change the absolute value of the transfer current.

In the image forming apparatus 100, as described above, the control section 50 determines whether or not to change the value of the transfer current according to whether or not the varistor 40 is conducting and leak current is flowing therethrough, that is, whether or not paper P is moist. It is therefore possible to supply an appropriate value of transfer current to the transfer roller 26 and reduce the possibility of an image defect even if paper P is moist.

Figure 3:
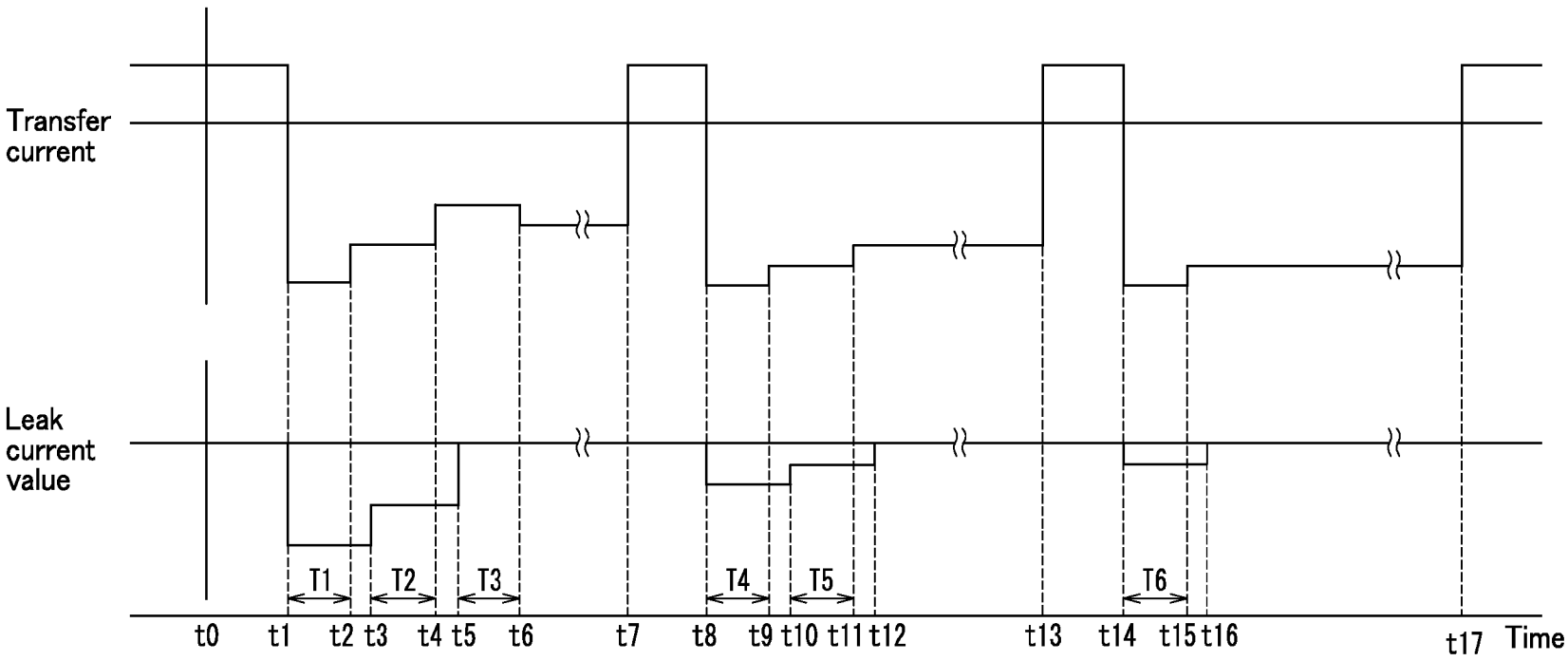
FIG. 3 is a timing diagram regarding transfer current and leak current values.

A method of controlling transfer current in the image forming apparatus 100 according to the present disclosure will be described with reference to FIGS. 2 and 3. FIG. 3 is a timing diagram regarding the transfer current and the leak current. The vertical axis in FIG. 3 represents the value of the transfer current supplied to the transfer roller 26 by the transfer bias applying section 28 and the value of the leak current measured by the current measurement section 42. The horizontal axis in FIG. 3 represents time. FIG. 3 is a timing diagram for image formation on three sheets of paper P. An image formation process on the first sheet of paper is performed during a period between time t1 and time t7. An image formation process on the second sheet of paper is performed during a period between time t8 and time t13. An image formation process on the third sheet of paper is performed during a period between time t14 and time t17. The period between time t7 and time t8 is a sheet interval between the first sheet of paper P and the second sheet of paper P. The period between time t13 and time t14 is a sheet interval between the second sheet of paper P and the third sheet of paper P. Positive transfer current is supplied to the transfer roller 26 during each sheet interval.

T1 to T6 are leak current measurement periods. The leak current measurement period T1 is a period between time t1 and time t2. The leak current measurement period T2 is a period between time t3 and time t4. The leak current measurement period T3 is a period between time t5 and time t6. The leak current measurement period T4 is a period between time t8 and time t9. The leak current measurement period T5 is a period between time t10 and time t11. The leak current measurement period T6 is a period between time t14 and time t15. The current measurement section 42 measures the leak current in each leak current measurement period. The leak current measurement periods are each defined by a specific period of time. The length of each leak current measurement period is 20 ms. Leak current measurement periods are provided also between time t6 and time t7, between time t12 and time t13, and between time t16 and time t17, which are not shown in order to avoid overcrowding the drawing.

Hereinafter, a method of controlling the transfer current by the control section 50 will be described. In a situation in which the absolute value of the leak current in a leak current measurement period is less than 1 μA (first threshold value), the control section 50 does not change the absolute value of the transfer current after the leak current measurement period. In a situation in which the absolute value of the leak current is no less than 1 μA (first threshold value) and less than 3 μA (second threshold value) in a leak current measurement period, the control section 50 decreases the absolute value of the transfer current by 1 μA (first amount) after the leak current measurement period. In a situation in which the absolute value of the leak current is no less than 3 μA (second threshold value) in a leak current measurement period, the control section 50 decreases the absolute value of the transfer current by 2 μA (second amount) after the leak current measurement period. In a situation in which the absolute value of the leak current is less than 1 μA (first threshold value) in one leak current measurement period and the control section 50 decreases the absolute value of the transfer current by 2 μA (second amount) after a leak current measurement period immediately preceding the one leak current measurement period, the control section 50 increases the absolute value of the transfer current by 1 μA (first amount) after the one leak current measurement period.

The method of controlling the transfer current by the control section 50 has been described so far. Hereinafter, a specific example of the method of controlling the transfer current by the control section 50 will be described with reference to FIG. 3.

At time t0, the transfer bias applying section 28 supplies positive transfer current to the transfer roller 26.

At time t1, an image formation process on the first sheet of paper P is started, whereupon the control section 50 changes the transfer current to −20 μA.

The current measurement section 42 measures the leak current in the leak current measurement period T1. In a situation in which the paper P is moist, the value of the leak current is relatively high. In the present example, the value of the leak current in the leak current measurement period T1 is −5 μA.

At time t2, the control section 50 changes the absolute value of the transfer current based on the absolute value of the leak current. The control section 50 for example calculates an average of leak current values measured during the leak current measurement period T1 and changes the absolute value of the transfer current based on the absolute value of the average of the leak current values. In the present example, the value of the leak current is −5 μA, and therefore the control section 50 decreases the absolute value of the transfer current by 2 μA (second amount). That is, the control section 50 changes the transfer current from −20 μA to −18 μA.

The current measurement section 42 measures the leak current in the leak current measurement period T2. Since the control section 50 changes the transfer current from −20 μA to −18 μA at time t2, the value of the leak current in the leak current measurement period T2 is smaller than the value of the leak current in the leak current measurement period T1. In the present example, the value of the leak current in the leak current measurement period T2 is −3 μA.

At time t4, the control section 50 decreases the absolute value of the transfer current by 2 μA (second amount) since the value of the leak current is −3 μA in the present example. That is, the control section 50 changes the transfer current from −18 μA to −16 μA.

The current measurement section 42 measures the leak current in the leak current measurement period T3. Since the control section 50 changes the transfer current from −18 μA to −16 μA at time t4, the value of the leak current in the leak current measurement period T3 is smaller than the value of the leak current in the leak current measurement period T2. In the present example, the value of the leak current in the leak current measurement period T3 is 0 μA.

Since the absolute value of the leak current is less than 1 μA (first threshold value) at time t6 and the control section 50 decreases the absolute value of the transfer current by 2 μA (second amount) after the immediately preceding leak current measurement period, the control section 50 increases the absolute value of the transfer current by 1 μA (first amount) after the leak current measurement period T3. That is, the control section 50 changes the transfer current from −16 μA to −17 μA.

The transfer current is constant at −17 μA from time t6 to time t7 since the value of the leak current is 0 μA. At time t7, the image formation process on the first sheet of paper P is completed.

Next, at time t8, an image formation process on the second sheet of paper P is started, whereupon the control section 50 changes the transfer current to −20 μA.

The current measurement section 42 measures the leak current in the leak current measurement period T4. In the present example, the value of the leak current in the leak current measurement period T4 is −2 μA.

At time t9, the control section 50 changes the absolute value of the transfer current based on the absolute value of the leak current. Since the value of the leak current is −2 μA, the control section 50 decreases the absolute value of the transfer current by 1 μA (first amount). That is, the control section 50 changes the transfer current from −20 μA to −19 μA.

The current measurement section 42 measures the leak current in the leak current measurement period T5. Since the control section 50 changes the transfer current from −20 μA to −19 μA at time t9, the value of the leak current in the leak current measurement period T5 is smaller than the value of the leak current in the leak current measurement period T4. In the present example, the value of the leak current in the leak current measurement period T5 is −1 μA.

At time t11, the control section 50 changes the absolute value of the transfer current based on the absolute value of the leak current. Since the value of the leak current is −1 μA, the control section 50 decreases the absolute value of the transfer current by 1 μA (first amount). That is, the control section 50 changes the transfer current from −19 μA to −18 μA.

The transfer current is constant at −18 μA from time t12 to time t13 since the value of the leak current is 0 μA. At time t13, the image formation process on the second sheet of paper P is completed.

Next, at time t14, an image formation process on the third sheet of paper P is started, whereupon the control section 50 changes the transfer current to −20 μA.

The current measurement section 42 measures the leak current in the leak current measurement period T6. In the present example, the value of the leak current in the leak current measurement period T6 is −1 μA.

At time t15, the control section 50 changes the absolute value of the transfer current based on the absolute value of the leak current. Since the value of the leak current is −1 μA, the control section 50 decreases the absolute value of the transfer current by 1 μA (first amount). That is, the control section 50 changes the transfer current from −20 μA to −19 μA.

The transfer current is constant at −19 μA from time t16 to time t17 since the value of the leak current is 0 μA. At time t17, the image formation process on the third sheet of paper P is completed.

As described above, the control section 50 in the image forming apparatus 100 changes the absolute value of the transfer current based on the absolute value of the leak current. That is, the control section 50 changes the absolute value of the transfer current based on the degree of moisture in the paper P. It is therefore possible to supply an appropriate value of transfer current to the transfer roller 26 according to the degree of moisture in the paper P and reduce the possibility of an image defect.

The control section 50 changes the absolute value of the transfer current based on the absolute value of the leak current after each leak current measurement period. Accordingly, image formation processes can be performed continually at an appropriate transfer current. As a result, image formation processes can be performed at an appropriate transfer current even if paper P is moist in part.

The control section 50 changes the absolute value of the transfer current in a situation in which the absolute value of the leak current is no less than a threshold value. That is, the control section 50 changes the absolute value of the transfer current in a situation in which the paper P is moist and therefore the leak current is greater. It is therefore possible to supply an appropriate value of transfer current to the transfer roller 26 and reduce the possibility of an image defect.

The control section 50 changes the absolute value of the transfer current by the first amount when the absolute value of the leak current is no less than the first threshold value and less than the second threshold value. The control section 50 changes the absolute value of the transfer current by the second amount when the absolute value of the leak current is no less than the second threshold value. With the two threshold values, the transfer current is changed to a greater extent when the leak current is greater, and the transfer current is changed to a smaller extent when the leak current is smaller. As a result, the control section 50 can quickly control the transfer current to an appropriate value.

In a situation in which the absolute value of the leak current is less than the first threshold value in one leak current measurement period and the control section 50 decreases the absolute value of the transfer current by the second amount after a leak current measurement period immediately preceding the one leak current measurement period, the control section 50 increases the absolute value of the transfer current so that the absolute value of the transfer current in a leak current measurement period following the one leak current measurement period is greater by the first amount. Thus, the transfer current can be prevented from being decreased too much. It is therefore possible to supply an appropriate value of transfer current to the transfer roller 26 and reduce the possibility of an image defect.

It is preferable that an area of contact between the paper P and the photosensitive drum 20 (hereinafter, referred to simply as a "contact area") is larger in the case where the paper P is moist than in the case where the paper P is not moist.

In a situation in which the absolute value of the leak current is no less than a threshold value, the control section 50 reduces an angle of paper P entering the pressing part N relative to the photosensitive drum 20 (hereinafter, referred to simply as an "entrance angle").

For example, in a situation in which the absolute value of the leak current is no less than a threshold value, the control section 50 controls the conveyance speed of the paper P at the registration roller pair 30 to be faster than the conveyance speed of the paper P at the pressing part N. More specifically, the conveyance speed of the paper P at the pressing part N is controlled to be 100 mm/second, and the conveyance speed of the paper P at the registration roller pair 30 is controlled to be 101 mm/second. The conveyance speed difference created by varying the conveyance speeds causes flexing of the paper P. As a result, the entrance angle becomes smaller, and the contact area becomes larger compared to the case where flexing of the paper P is not caused. Consequently, the gap between the paper P and the photosensitive drum 20 is reduced to allow toner to be transferred to a desired location on the paper P, reducing the possibility of an image defect.

Figure 4A:
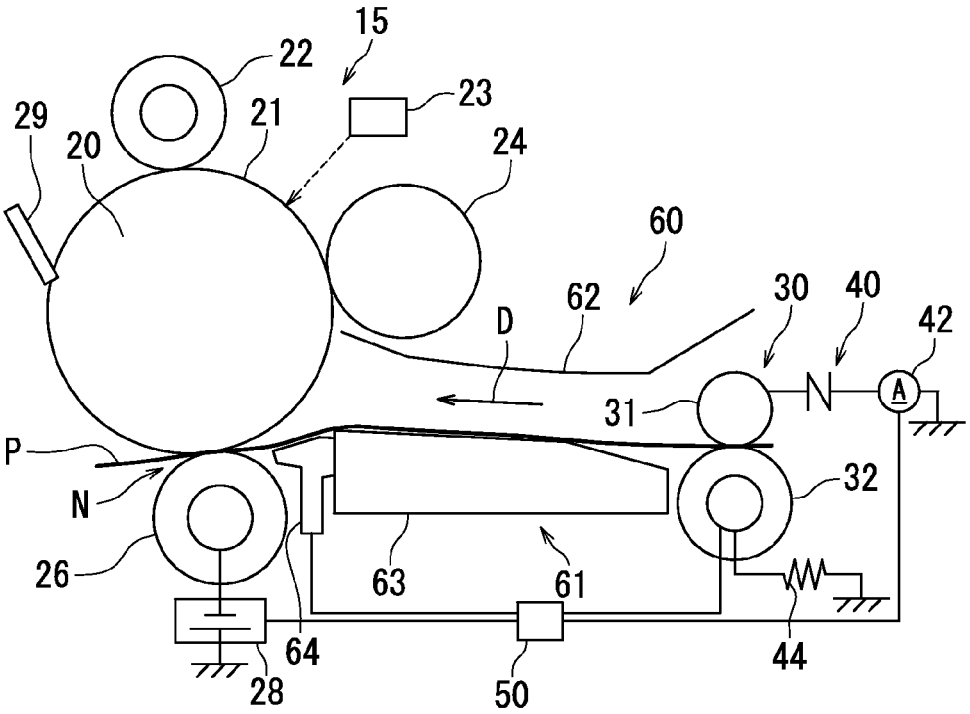
FIGS. 4A and 4B are diagrams illustrating configuration of an example of an image forming section and elements therearound according to the embodiment.
Figure 4B:
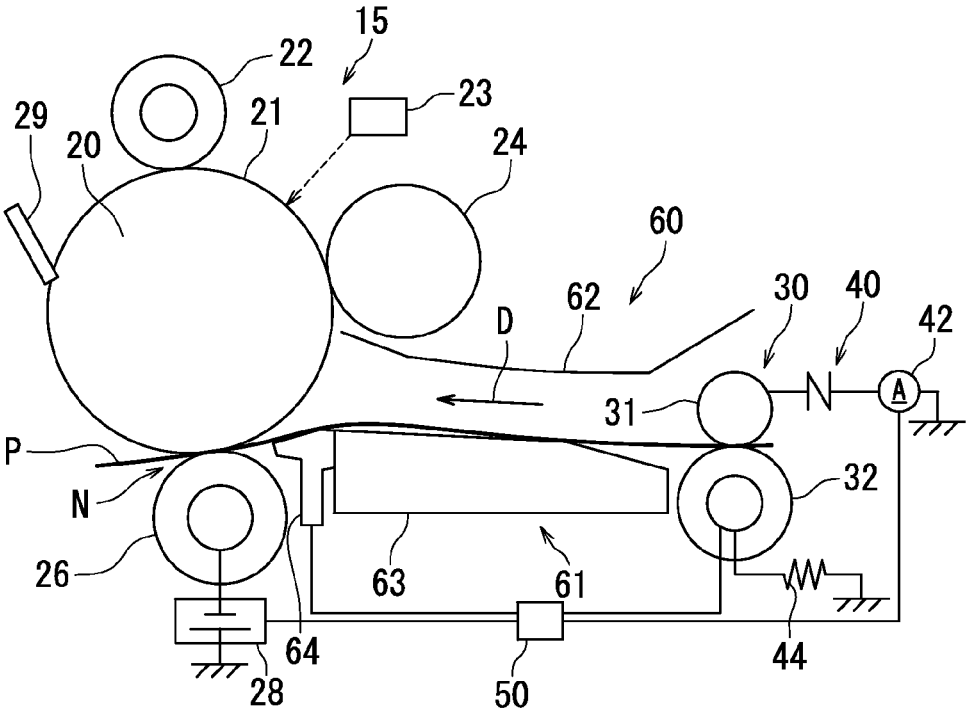

The image forming apparatus 100 according to the present disclosure will be described with reference to FIGS. 4A and 4B. FIGS. 4A and 4B are diagrams illustrating configuration of an example of the image forming section 15 and elements therearound according to the embodiment. This image forming apparatus 100 has the same configuration as the image forming apparatus 100 described with reference to FIG. 2 except that the first guide member 61 has a fixed portion 63 and a movable portion 64, and therefore the same description is not repeated.

The first guide member 61 has the fixed portion 63 and the movable portion 64. The movable portion 64 is located downstream of the fixed portion 63 in the conveyance direction D. The movable portion 64 is movable in a direction intersecting with the conveyance direction D. In the present embodiment, the movable portion 64 is movable in an up-down direction in FIGS. 4A and 4B. The movable portion 64 is positioned by a cam having a minor radius of 12 mm and a major radius of 13 mm. The control section 50 can change the position of the movable portion 64 by rotating the cam.

The control section 50 changes the position of the movable portion 64 based on the absolute value of the leak current. More specifically, in a situation in which the paper P is not moist, that is, in a situation in which the absolute value of the leak current is less than a threshold value, the movable portion 64 is in a position illustrated in FIG. 4A. In a situation in which the paper P is moist, that is, in a situation in which the absolute value of the leak current is no less than an threshold value, the control section 50 performs positioning of the movable portion 64 by rotating the cam and using the major radius of the cam so as to change (push up) the position of the movable portion 64 to a position illustrated in FIG. 4B. Thus, the conveyance path of the paper P is changed, and the entrance angle of the paper P when the absolute value of the leak current is no less than the threshold value (as illustrated in FIG. 4B) is made smaller than when the absolute value of the leak current is less than the threshold value (as illustrated in FIG. 4A). Consequently, the contact area is increased and the gap between the paper P and the photosensitive drum 20 is reduced to allow toner to be transferred to a desired location on the paper P, reducing the possibility of an image defect.

The image forming apparatus 100 described with reference to FIGS. 1 to 4B transfers a toner image onto paper P by direct transfer in which the paper P comes in direct contact with the photosensitive drum 20. Alternatively, the image forming apparatus 100 may transfer a toner image from the photosensitive drum 20 to an intermediate transfer belt 20*a*, and then transfer the toner image from the intermediate transfer belt 20*a* to paper P.

Figure 5:
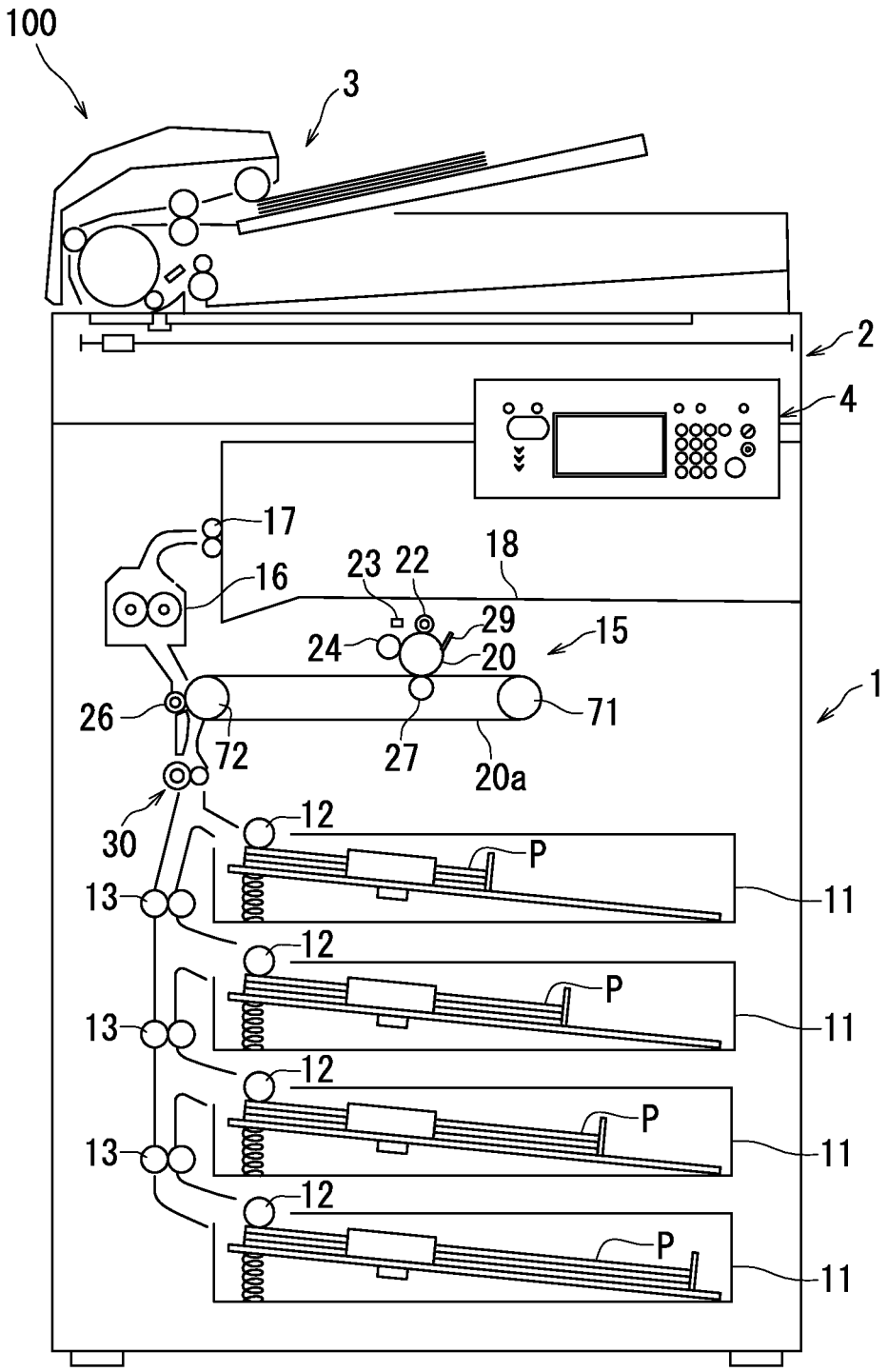
FIG. 5 is a diagram illustrating configuration of another example of the image forming apparatus according to the embodiment.

FIG. 5 is a diagram illustrating configuration of another example of the image forming apparatus 100 according to the embodiment. The same description as the description of the image forming apparatus 100 made with reference to FIG. 1 will be omitted. The image forming apparatus 100 of the present example transfers a toner image to paper P by an intermediate transfer belt method in which the toner image is first transferred from the photosensitive drum 20 to the intermediate transfer belt 20*a*, and then transferred from the intermediate transfer belt 20*a* to the paper P.

The image forming section 15 further includes the intermediate transfer belt 20*a*, a primary transfer roller 27, a drive roller 71, and a pressing roller 72. In the image forming apparatus 100, the photosensitive drum 20 and the intermediate transfer belt 20*a* are image bearing members, and the transfer roller 26 is a transfer section. Rotation of the drive roller 71 causes rotation of the intermediate transfer belt 20*a*.

First, a toner image on the image bearing surface of the photosensitive drum 20 is transferred to the intermediate transfer belt 20*a* by the primary transfer roller 27. The toner image on the intermediate transfer belt 20*a* is then transferred to paper P by the transfer roller 26.

As in the image forming apparatus 100 described with reference to FIG. 1, the control section 50 changes the absolute value of the transfer current based on the degree of moisture in paper P. It is therefore possible to supply an appropriate value of transfer current to the transfer roller 26 according to the degree of moisture in the paper P and reduce the possibility of an image defect.

The embodiment of the present disclosure has been described with reference to the drawings (FIGS. 1 to 5) so far. However, the present disclosure is not limited to the above-described embodiment and can be practiced in various ways within the scope without departing from the essence of the present disclosure (for example, as described below in sections (1)-(4)). The drawings are intended to emphasize the components in a schematic manner to assist with understanding. The thickness, the length, the number, and so on of the components illustrated are not true to scale for diagrammatic purposes. The material, the shape, the dimensions, and so on of each component shown in the above-described embodiment are only exemplary and do not represent any particular limitations. Various alterations can be made thereto within the scope without substantially departing from the effect of the present disclosure.

(1) As described with reference to FIGS. 1 and 2, the varistor is employed as an element that is connected with the conveyance section 30 in the present embodiment. Alternatively, a zener diode may be employed as the element that is connected with the conveyance section 30.

(2) As described with reference to FIG. 3, the control section 50 controls the transfer bias applying section 28 to decrease the absolute value of the transfer current in a situation in which the absolute value of the leak current is no less than a threshold value in the present embodiment. Alternatively, the control section 50 may control the transfer bias applying section 28 to increase the absolute value of the transfer current. Increasing the absolute value of the transfer current enables appropriate transfer in a system requiring a high transfer bias for the transfer.

(3) As described with reference to FIG. 3, the control section 50 controls the transfer current using two threshold values (the first threshold value and the second threshold value) in the present embodiment. However, the number of threshold values may not be two. For example, one threshold value or three threshold values may be used.

(4) As described with reference to FIGS. 1 and 2, the image forming apparatus employs the reversal development as a development scheme in the present embodiment. Alternatively, another development scheme may be employed. For example, the development scheme may be normal development in which an image bearing member is charged to a polarity opposite to the polarity of toner for development.

What is claimed is:

1. An image forming apparatus comprising:

an image bearing member that bears a toner image thereon;

a transfer section that forms, in conjunction with the image bearing member, a pressing part where a recording medium is pressed and that is configured to transfer the toner image from the image bearing member to the recording medium as the recording medium passes through the pressing part;

a transfer bias applying section that supplies transfer current to the transfer section to apply a transfer bias to the transfer section;

a conveyance section that conveys the recording medium in a conveyance direction toward the pressing part;

an element that is connected with the conveyance section and conducts when a voltage equal to or greater than a prescribed value is applied thereto;

a current measurement section that measures a value of leak current, the leak current being a current flowing through the element; and a control section that controls a value of the transfer current, wherein the current measurement section measures the leak current for each of leak current measurement periods that are each defined by a specific period of time, when an absolute value of the leak current in one leak current measurement period of the leak current measurement periods is not less than a threshold value, the control section changes an absolute value of the transfer current after the leak current measurement period, the threshold value includes a first threshold value and a second threshold value, the control section changes the absolute value of the transfer current by a first amount when the absolute value of the leak current is not less than the first threshold value and less than the second threshold value, the control section changes the absolute value of the transfer current by a second amount when the absolute value of the leak current is not less than the second threshold value, and when the absolute value of the leak current in one leak current measurement period of the leak current measurement periods is less than the first threshold value and the control section decreases the absolute value of the transfer current by the second amount after a leak current measurement period immediately preceding the one leak current measurement period, the control section increases the absolute value of the transfer current so that the absolute value of the transfer current in a leak current measurement period following the one leak current measurement period is greater by the first amount.

2. The image forming apparatus according to claim 1, wherein the control section reduces an entrance angle of the recording medium entering the pressing part relative to the image bearing member when the absolute value of the leak current is not less than a threshold value.

3. The image forming apparatus according to claim 2, wherein the control section controls a conveyance speed of the recording medium at the conveyance section to be faster than a conveyance speed of the recording medium at the pressing part when the absolute value of the leak current than not less than a threshold value.

4. The image forming apparatus according to claim 2, further comprising a guide member that guides the recording medium toward the pressing part, the guide member having a fixed portion and a movable portion that is located downstream of the fixed portion in the conveyance direction and is movable in a direction intersecting with the conveyance direction, wherein the control section changes a position of the movable portion based on the absolute value of the leak current.

5. The image forming apparatus according to claim 4, wherein the movable portion is movable in an up-down direction.

6. The image forming apparatus according to claim 1, wherein the control section calculates an average of leak current values measured during each of the leak current measurement periods and changes the absolute value of the transfer current based on an absolute value of the average of the leak current values.

7. The image forming apparatus according to claim 1, wherein the element is a varistor or a zener diode.

8. The image forming apparatus according to claim 1, wherein the image bearing member is a photosensitive drum, and the recording medium comes in direct contact with the photosensitive drum.

9. An image forming apparatus comprising:

an image bearing member that bears a toner image thereon;

a transfer section that forms, in conjunction with the image bearing member, a pressing part where a recording medium is pressed and that is configured to transfer the toner image from the image bearing member to the recording medium as the recording medium passes through the pressing part;

a transfer bias applying section that supplies transfer current to the transfer section to apply a transfer bias to the transfer section;

a conveyance section that conveys the recording medium in a conveyance direction toward the pressing part;

an element that is connected with the conveyance section and conducts when a voltage equal to or greater than a prescribed value is applied thereto;

a current measurement section that measures a value of leak current, the leak current being a current flowing through the element; and a control section that controls a value of the transfer current, wherein the control section changes an absolute value of the transfer current based on an absolute value of the leak current, and the control section reduces an entrance angle of the recording medium entering the pressing part relative to the image bearing member when the absolute value of the leak current is not less than a threshold value.

10. The image forming apparatus according to claim 9, wherein the control section controls a conveyance speed of the recording medium at the conveyance section to be faster than a conveyance speed of the recording medium at the pressing part when the absolute value of the leak current is not less than a threshold value.

11. The image forming apparatus according to claim 9, further comprising a guide member that guides the recording medium toward the pressing part, the guide member having a fixed portion and a movable portion that is located downstream of the fixed portion in the conveyance direction and is movable in a direction intersecting with the conveyance direction, wherein the control section changes a position of the movable portion based on the absolute value of the leak current.

12. The image forming apparatus according to claim 11, wherein the movable portion is movable in an up-down direction.

13. The image forming apparatus according to claim 9, wherein the element is a varistor or a zener diode.

14. The image forming apparatus according to claim 9, wherein the image bearing member is a photosensitive drum, and the recording medium comes in direct contact with the photosensitive drum.

* * * * *